United States Patent [19]

Killinger

[11] Patent Number: 4,505,213

[45] Date of Patent: Mar. 19, 1985

[54] STITCH LENGTH CONTROL FOR HAND OPERABLE SEWING MACHINE

[75] Inventor: Karl H. Killinger, Dover, N.J.

[73] Assignee: The Singer Company, Stamford, Conn.

[21] Appl. No.: 600,929

[22] Filed: Apr. 16, 1984

[51] Int. Cl.[3] ..... D05B 27/22; D05B 27/04; D05B 1/06; D05B 97/02

[52] U.S. Cl. ..... 112/315; 112/169; 112/320

[58] Field of Search ..... 112/320, 169, 197, 199, 112/11, 315

[56] References Cited

U.S. PATENT DOCUMENTS 1,809,192 6/1931 Cahill et al. .
3,837,306 9/1974 Doyel .
4,095,540 6/1978 Kaltenbach et al. ..... 112/315
4,411,210 10/1983 Killinger ..... 112/169 X
4,463,695 8/1984 Killinger ..... 112/169 X
4,474,123 10/1984 Ponte ..... 112/169 X

FOREIGN PATENT DOCUMENTS 57-12997 7/1979 Japan .
57-48872 3/1982 Japan .

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A hand operable chain stitch sewing machine is provided with a top work feeding arrangement wherein a feed dog is moved away from a stop to engage and move a work piece under a sewing needle. The stop is adjustable and may be positioned with an operator's control to predetermine stitch length.

5 Claims, 6 Drawing Figures

STITCH LENGTH CONTROL FOR HAND OPERABLE SEWING MACHINE

BACKGROUND OF THE INVENTION

1. Field of the Invention

The invention relates to chain stitch sewing machines and, more particularly, to work feeding arrangements thereof.

2. Description of the Prior Art

A hand operable chain stitch sewing machine with a top work feeding arrangement wherein a feed dog is mounted for pivotal movement about mutually perpendicular axes may be seen in my copending Patent Application for "Top Feeding Arrangement for a Chain Stitch Sewing Machine", filed May 16, 1984 with Ser. No. 600704. It is a prime object of the present invention to enable an operator to selectively control the extent of feed dog movement in such a machine and thereby stitch length in a workpiece.

SUMMARY OF THE INVENTION

A sewing machine according to the invention includes a feed dog with a work engaging end portion and a rearward extension, means mounting the feed dog along the rearward extension for pivotal movement about mutually perpendicular axes, an adjustable stop engageable with the feed dog, and mechanism responsive to the operation of a handle for moving a looper and needle into cooperative association for the formation of chain stitches. The looper and needle moving mechanism includes spring means which biases the handle to a hands off position and the feed dog into a position of engagement with the stop wherein the work engageable feed dog end portion is located over the workpiece. The feed dog is moved from the stop engaging position in response to operation of the handle, about one of the mutually perpendicular axes to bring the work engageable end position of the feed dog into engagement with a workpiece, and about the other axis while engaged with the workpiece to move the workpiece relative to the needle. A stitch length control operably connected with the stop enables an operator to position the stop and thereby predetermine the extent to which work is displaced by the feed dog during the movement thereof about said other axis.

DESCRIPTION OF THE PREFERRED EMBODIMENT

Figure 1:
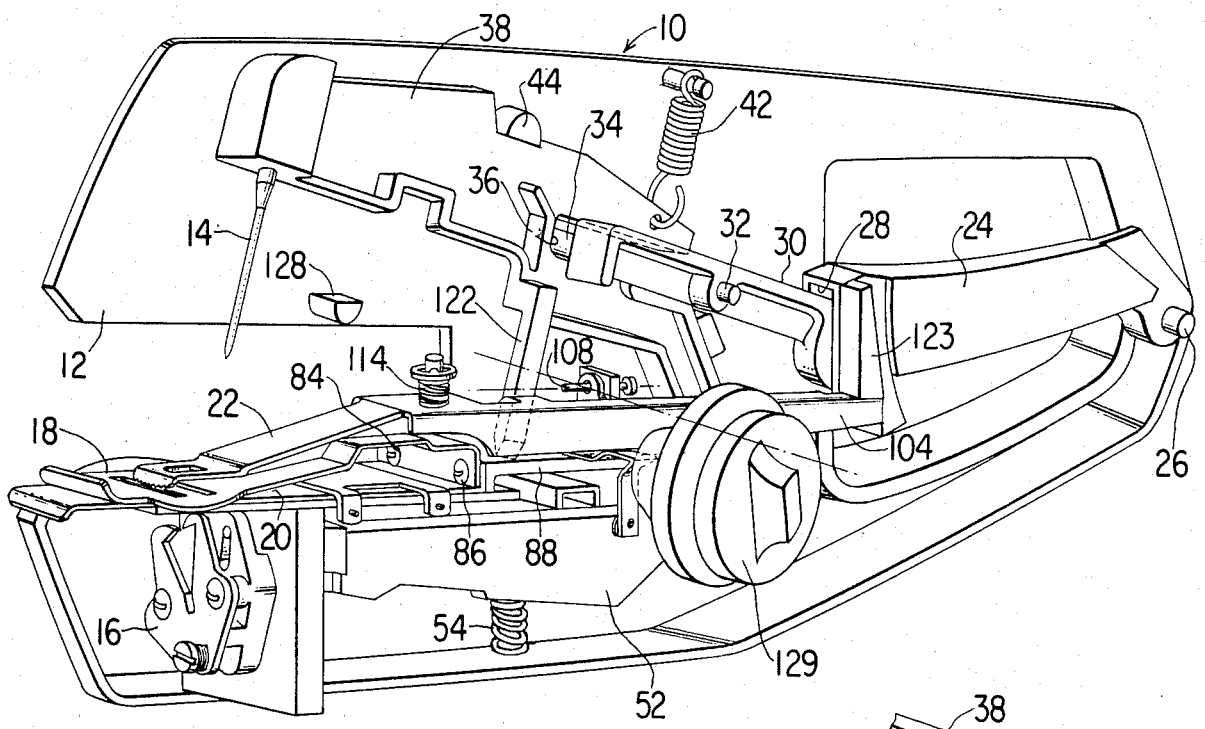
FIG. 1 is a perspective side view of a machine according to the invention having one side of the frame removed to show internal parts.
Figure 2:
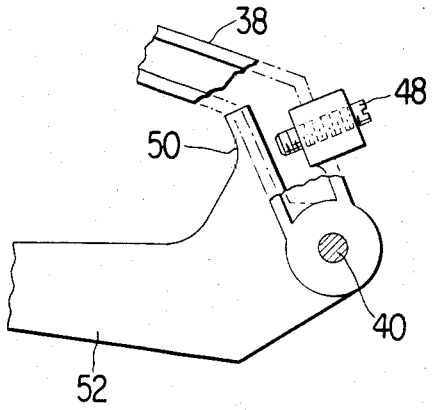
FIG. 2 is a fragmentary side view showing a portion of the machine of FIG. 1.
Figure 3:
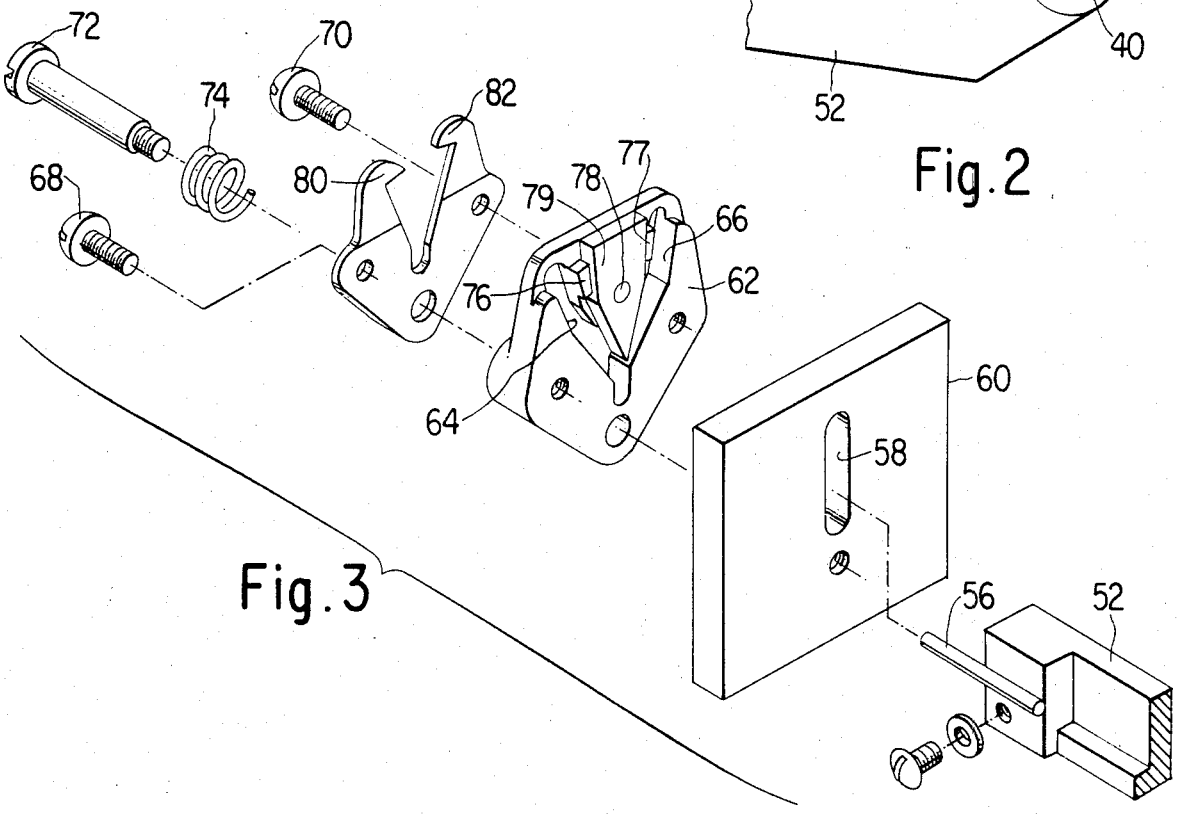
FIG. 3 is a fragmentary exploded perspective view showing the looper actuating mechanism of the machine.
Figure 4:
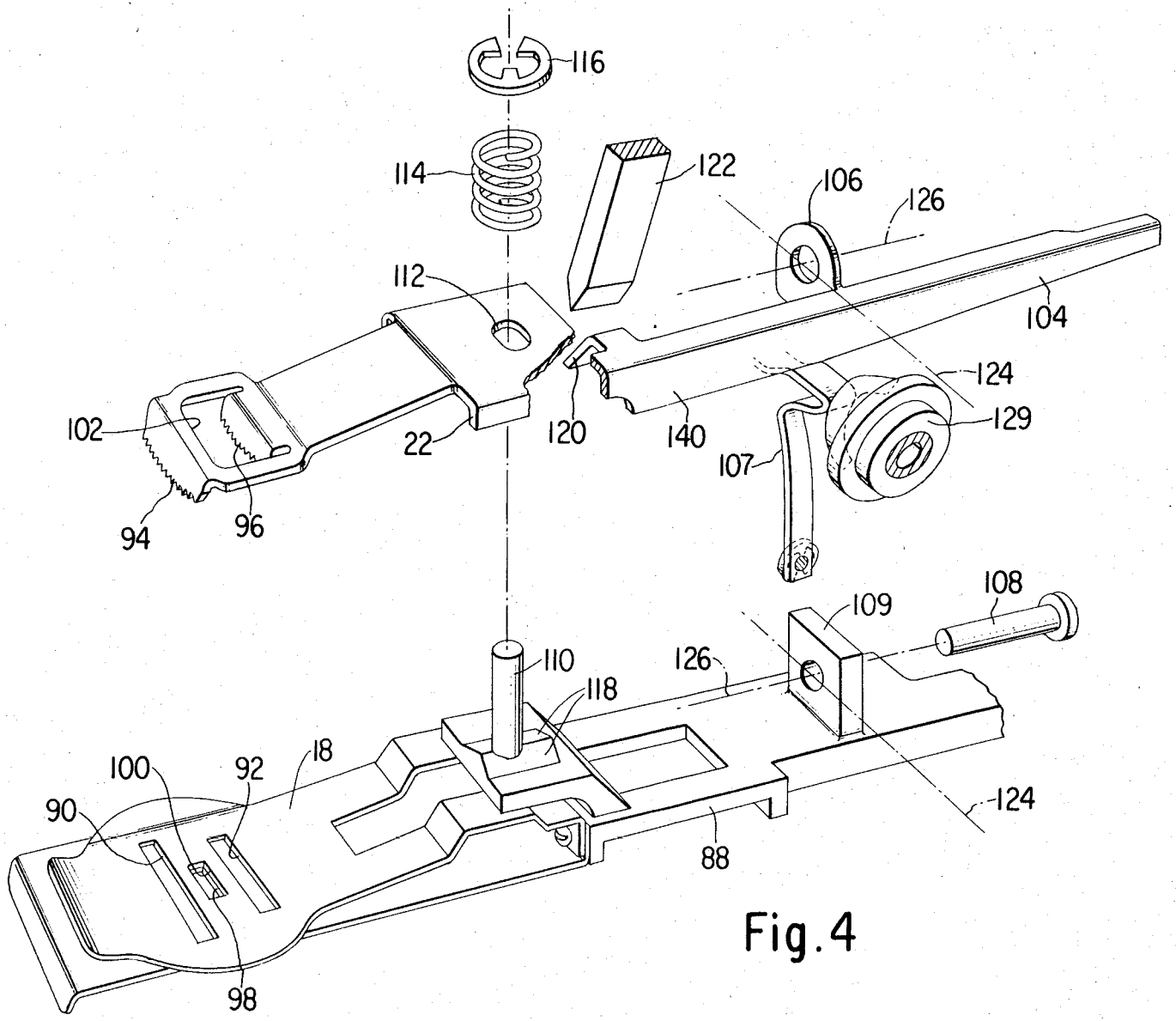
FIG. 4 is a fragmentary exploded perspective view showing the work feeding arrangement of the machine.

Referring to the drawings, there is shown a hand held sewing machine 10 according to the invention, including a frame 12, a thread carrying needle 14 arranged for reciprocating movement, and a pivotally movable looper 16 which cooperates with the needle in the formation of chain stitches. A pressure plate 18 serves to hold material against a rigid bed plate 20, and a topside feed dog 22 is provided to move the material under the needle during a sewing operation. A handle 24 having one end pivotally attached at 26 to the frame 12 is operably connected to the needle 14, looper 16 and feed dog 22 for imparting the desired movements thereto.

Handle 24 connects in a slot 28 with one end of a link 30 which is pivotally mounted on a pin 32 affixed in frame 12. The opposite end of link 30 includes a laterally projecting pin 34 which extends into a slot 36 in an arm 38 that carries needle 14 at one end and is pivotally mounted at the other end on a shaft 40 affixed in frame 12. Arm 38 is biased upwardly by spring 42 into engagement with a stop 44. The arm is caused to move downwardly and dispose needle 14 for cooperation with the looper 16 whenever handle 24 is squeezed upwardly. When handle 24 is released, the arm is returned to a position of engagement with stop 44 by spring 42.

Arm 38 carries an adjustable screw 48 which is caused during a latter portion of the descent of arm 38 to engage an upward extension 50 on a looper drive arm 52, and move the drive arm downwardly about one end pivoted on shaft 40 against the bias of a return spring 54. A drive pin 56 projects outwardly from the free end extremity of arm 52 and extends through a vertical pin guiding slot 58 in a guide block 60 which is rigidly attached to frame 12. Pin 56 extends beyond block 60 to engage a cam 62 along a cam track 64. Looper 16 is affixed to cam 62 with screws 68 and 70, and the assembly is mounted on block 60 with a shouldered screw 72 and spring 74 for pivotal movement on the screw 72. Cam 62 includes a fixed pin 78 which supports a gate 79 in a stationary position between confining abutments 76 and 77 on the cam. The gate permanently blocks access by pin 56 to a track 66 in cam 62, but permits the pin to slidingly engage track 64 and thereby effect pivotal movement as required to place a loop seizing point 80 on the looper into cooperative association with the needle 14 to provide for the formation of chain stitches in a manner well understood in the art. Although track 66 isn't utilized in the machine of the present invention, it is shown to illustrate the possible use of a cam 62 of the kind disclosed in my copending patent application for "Feeding Mechanism for Double Pointed Looper Sewing Machine", with Ser. No. 461,825, filed Jan. 28, 1983 Pat. No. 4,463,695. Since pin 56 never enters track 66, a second looper point 82 shown on looper 16 isn't disposed into cooperative association with needle 14, and therefor doesn't enter into the stitch forming process. The second looper point 82 is shown to illustrate the possible use of a looper 16 of the kind disclosed in the said patent application with Ser. No. 461,825.

Bed plate 20 and presser plate 18 are affixed with screws 84 and 86 to one end of a member 88 which is suitably secured against movement to the frame of the machine. The presser plate is of a resilient material and is biased against the bed plate. Slots 90 and 92 are provided in the presser plate 18 to permit teeth 94 and 96 at one end of the feed dog 22 to extend through the presser plate and engage material disposed between the presser plate 18 and bed plate 20. Slots 98, 100 and 102 in the bed plate, presser plate and feed dog respectively, permit the needle 14 to be moved through these members and cooperate with looper seizing point 80 on looper 16 in the formation of chain stitches.

The feed dog 22 includes a rearward extension 104 with a flange 106 thereon where the feed dog is loosely pivoted on a pin 108 extending through the flange 106, and through a flange 109 on frame affixed member 88. A fixed pin 110 on member 88 in a common longitudinally extending plane with pin 108 projects upwardly through an elliptical slot 112 in the feed dog, and a spring 114 between the feed dog and a resilient E ring 116 on the pin biases the feed dog against a cam 118 on member 88. The feed dog extension 104 includes an angularly depending cam 120 which is engageable with a plunger 122 that is an integral part of arm 38.

Handle 24 is biased by the action of spring 42 to a hands off position in which feed dog extension 104 is engaged by a handle appendage 123, and caused to assume a position against an adjustable spring stop 107 defining an initial position for the feed dog with the feed dog teeth above the presser plate and and work piece thereunder.

When handle 24 is squeezed upwardly, appendage 123 is released from engagement with feed dog extension 104, and the feed dog 22 is pivoted by spring 114 on the loose pivotal mount at pin 108 about a transverse axis 124 substantially perpendicular to the axis 126 of pin 108 to thereby bring the feed dog teeth 94 and 96 into engagement with a work piece under the presser plate 18. As the squeezing of the handle 24 is continued, plunger 122 on arm 38 acts against cam 120 to pivot the feed dog about axis 126 and cause the feed dog teeth 94 and 96 to move the work piece under needle 14 to a limited position defined by the engagement of arm 38 with a stop 128. The feed dog teeth extend along arcuate peripheries, as shown and thereby assure the continued engagement of teeth with the work piece during said pivotal movement of the feed dog about axis 126. As noted hereinbefore, during the upward squeezing of handle 24, needle 14 is moved downwardly by the handle acting through link 30 and arm 38, and the looper 16 is moved by the arm 38 acting through drive arm 52 to dispose the looper for cooperation with the needle in the formation of chain stitches. The needle penetrates the work piece to provide for the formation of a stitch only after the work piece has been moved by the feed dog and while the feed dog is being held stationary by engagement of the plunger 122 with cam 120.

When the handle 24 is released, the looper 16 and needle 14 are returned to initial positions by the action of springs 54 and 42, respectfully. Appendage 123 on handle 24 engages the feed dog extension 104 as the plunger 122 disengages cam 120, and the feed dog is caused by the appendage to pivot on the loose pivotal mount at pin 108 about both of the axes 124 and 126. The feed dog teeth are therefore lifted from the work piece and the feed dog is returned to its initial position. The handle comes to rest in the hands off position defined by the engagement of appendage 123 with feed dog extension 104, and of the extension 104 with spring stop 107. The described operative cycle is repeated as many times as may be required to perform the sewing task at hand.

The extent to which a work piece is moved under needle 14 during each operative cycle of the machine, and therefore the length of stitches sewn may be selectively predetermined by the positioning of spring stop 107 with a knob 129 which is rotatably mounted in frame 12. Spring stop 107 is a resilient sheet metal member with a substantially flat and ramped portion 130 and 132, respectively, at a free end which is biased by the natural resiliency of the part against fixed member 88. The opposite end of the spring stop is secured as with a spring washer 134 to frame 12, and an intermediate portion 136 is engaged by a cam 138 which is affixed to knob 129. By turning knob 129, spring stop 107 may be disposed to have flat portion 130 or any part of ramped portion 132 engage feed dog extension 104 at depending lip 140, and establish an initial position from which the feed dog is moved in response to the upward squeezing of handle 24.

Figure 5:
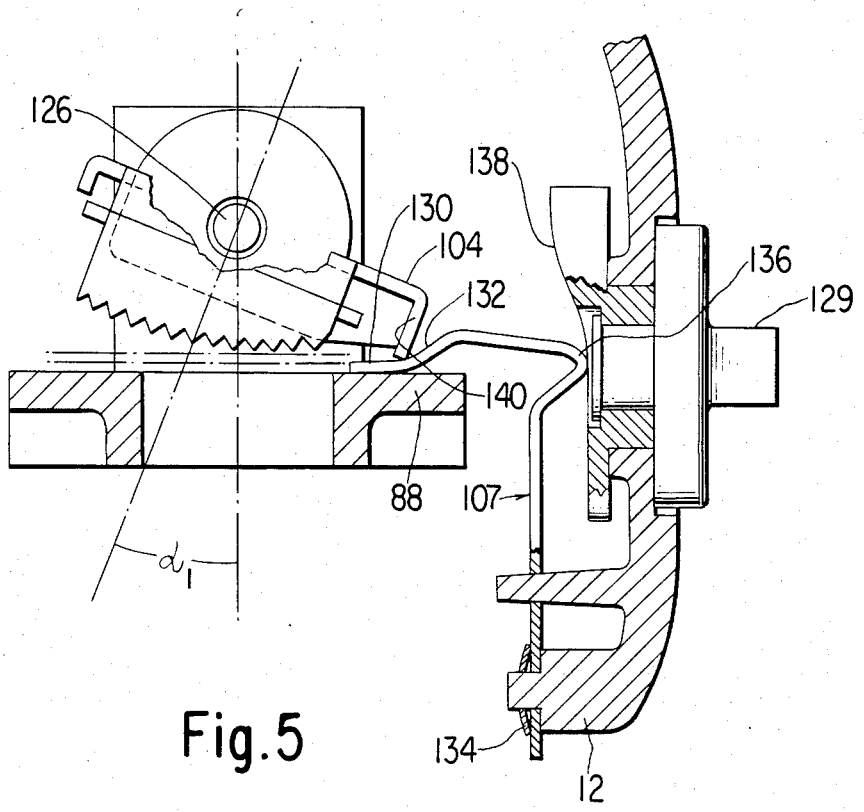
FIG. 5 is a transverse sectional view showing the stitch length control mechanism of the invention as disposed for the sewing of stitches of maximum length on the machine.
Figure 6:
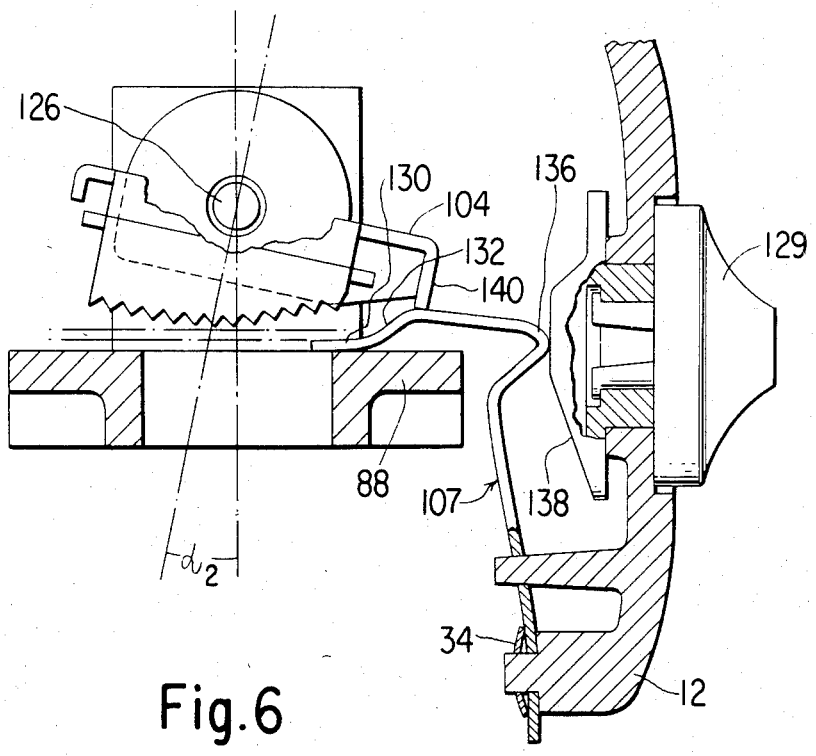
FIG. 6 is a view similar to FIG. 4 showing the stitch length control mechanism as disposed for the sewing of stitches of minimum stitch length.

In FIG. 5, the spring stop 107 has been disposed by knob 129 to have the flat portion 130 in engagement with feed dog extension 104 at lip 140. The greatest latitude is then afforded for movement of the feed dog 22 about pivotal axis 126 (i.e. through angle $\alpha_1$, to the limited position defined by engagement of arm 38 with stop 128), and stitches of maximum length may be sewn. In FIG. 6, spring stop 107 has been disposed by knob 129 for engagement with lip 140 at the top of ramp portion 132. Movement of the feed dog about axis 126 is then restricted by stop 107 to a small angle $\alpha_2$, and only stitches of minimum length may be sewn. For positions of the spring stop wherein intermediate positions of the ramp portion 132 engage lip 140, stitches of intermediate length may be sewn.

It is to be understood that the present disclosure relates to a preferred embodiment of the invention which is for purposes of illustration only and is not to be construed as limiting the invention. Numerous alterations and modification of the structure herein disclosed will suggest themselves to those skilled in the art, and all such modifications and alterations which do not depart from the spirit and scope of the invention are intended to be included within the scope of the appended claims.

I claim:

1. In a sewing machine, a sewing needle; a looper with a loop seizing point; a feed dog with a work engageable end portion and a rearward extension; means mounting the feed dog along the rearward extension for pivotal movement about mutually perpendicular axes; an adjustable stop engageable with the feed dog; a work supporting bed; a pressure plate for holding the work piece against the bed, said plate including one or more openings for the feed dog end portion to extend through and engage the work piece; a movable handle; mechanism responsive to the operation of the handle for moving the looper and needle into cooperative association for the formation of chain stitches, said mechanism including spring means which biases the handle to a hands off position and the feed dog into a position of engagement with the stop wherein the work engageable feed dog end portion is located over the work piece; means responsive to the operation of the handle for pivoting the feed dog from the stop engaging position about one of said axes to thereby move the work engageable end portion downwardly into engagement with the work piece, and for moving the feed dog about the other axis while engaged with the work piece to thereby move the work piece relative to the needle; and a stitch length control operably connected with the stop to enable an operator to position the stop and there predetermine the extent to which work is displaced by the feed dog during the movement thereof about said other axis.

2. The combination of claim 1 wherein the adjustable stop is a resilient member.

3. The combination of claim 2 wherein said resilient member is formed with a ramp engageable at different locations therealong with the feed dog to establish different initial feed dog positions.

4. The combination of claim 1 including a cam movable by said control and in engagement with said stop for adjusting the position of the stop in response to movement of the control.

5. The combination of claim 1 wherein the stop is a spring which is biased against said cam.

* * * * *